United States Patent [19]

Kirjavainen

[11] 4,166,759

[45] Sep. 4, 1979

[54] APPARATUS FOR DAMPING PULP STOCK PRESSURE FLUCTUATIONS IN A HEADBOX

[75] Inventor: Alvi Kirjavainen, Jyväskylä, Finland

[73] Assignee: Valmet Oy, Finland

[21] Appl. No.: 839,503

[22] Filed: Oct. 5, 1977

[30] Foreign Application Priority Data

Oct. 5, 1976 [FI] Finland ..... 762827

[51] Int. Cl.[2] ..... D21F 1/02; D21F 1/06

[52] U.S. Cl. ..... 162/337; 138/30; 162/340; 162/380

[58] Field of Search ..... 162/336, 337, 340, 380; 138/30, 26

[56] References Cited

U.S. PATENT DOCUMENTS

| | | | |
|---|---|---|---|
| 2,448,118 | 8/1948 | Pellettere | 138/30 |
| 2,535,732 | 12/1950 | Goodwillie | 162/340 X |
| 3,563,852 | 2/1971 | Rojecki | 162/340 X |
| 3,802,960 | 4/1974 | Spengos et al. | 162/336 X |
| 4,030,971 | 6/1977 | Justus | 162/340 X |
| 4,063,997 | 12/1977 | Kirjavainen et al. | 162/340 |

*Primary Examiner*—Richard V. Fisher

*Attorney, Agent, or Firm*—Steinberg & Blake

[57] ABSTRACT

A headbox of a paper machine includes a header chamber for receiving pulp stock, a distribution pipe system for receiving pulp stock from the header chamber, a flow-equalizing chamber for receiving pulp stock from the distribution pipe system, a turbulence passage system for receiving pulp stock from the flow-equalizing chamber, and a lip slice for receiving pulp stock from the turbulence passage system and discharging the pulp stock from the headbox. At least one of the above chambers is defined in part by a movable wall structure which has an inner surface contacting the pulp stock so that this movable wall structure can move in response to pressure fluctuations in the pulp stock. This wall structure has an outer surface which defines part of the hollow interior of an enclosure in which air under pressure is situated, so that through the movable wall structure the air under pressure can act on the pulp stock to damp pressure fluctuations thereof.

13 Claims, 10 Drawing Figures

FIG. 9
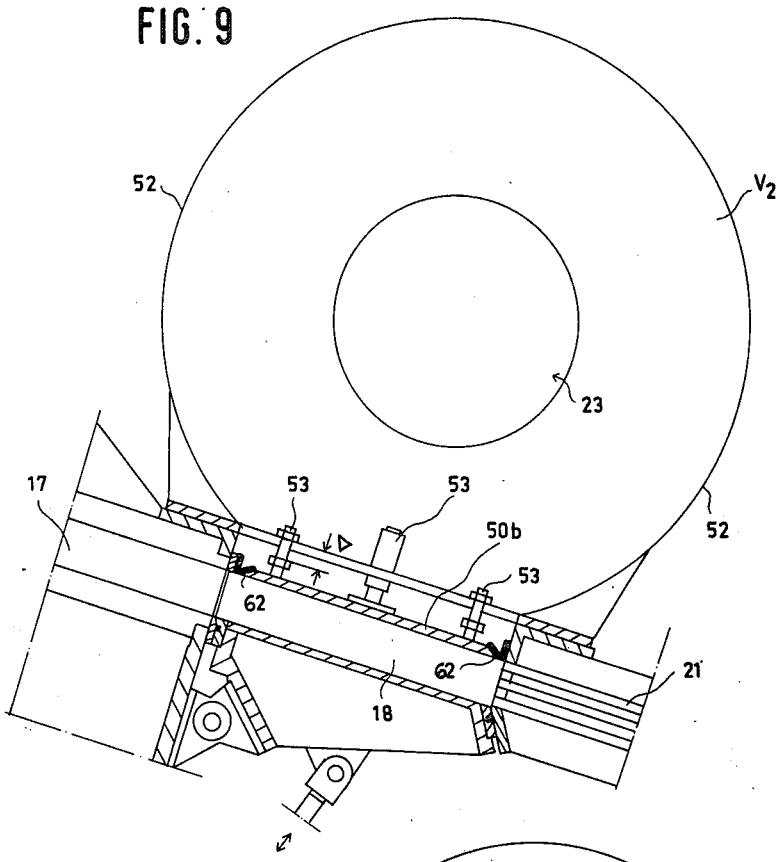
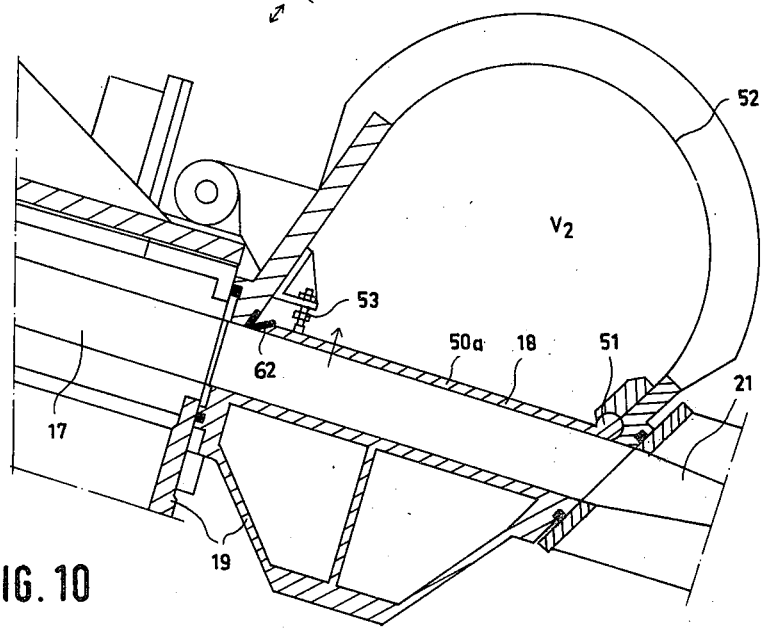
FIG. 10

APPARATUS FOR DAMPING PULP STOCK PRESSURE FLUCTUATIONS IN A HEADBOX

BACKGROUND OF THE INVENTION

The present invention relates to paper machines and in particular to the headboxes of paper machines.

In particular, the present invention relates to a hydraulic headbox of a paper machine, the pulp stock flowing in this headbox from a header thereof through a distribution pipe system to an equalizing chamber and from the latter through a turbulence passage system to the lip slice of the headbox. With the present invention, part of the above headbox structure cooperates with an air tank which contains air under pressure.

In general paper machine headboxes may be divided into three main groups, namely, (a) headboxes provided with an air cushion which communicates directly with the pulp stock in the headbox so as to provide a so-called air cushion headbox, (b) hydraulic headboxes provided with an air cushion separate from the headbox itself, where air tanks are located either at a part of the pipe system which delivers the pulp stock to the header of the headbox or at the headbox itself downstream of the header, for example, and (c) hydraulic headboxes which have no air cushion at all.

The use of an air cushion in connection with a headbox is intended to equalize pressure fluctuations occurring in the pulp suspension flowing toward the discharge aperture or lip slice of the headbox. Such pressure fluctuations may originate in the pulp stock flow system upstream of the headbox or at the headbox itself. In the event that these pressure fluctuations are permitted to proceed all the way up to the lip of the headbox, they will result in velocity variations in the discharging pulp jet, and the consequence is that base weight variations will occur in the pulp web which is formed on the forming wire. Such longitudinal base weight variations cannot be entirely eliminated, during subsequent drying of the web, and thus such variations will be visible in the finished paper, detracting from the value thereof.

In order to achieve a uniform average flow velocity profile in the cross-machine direction, the upstream part of the headbox, in the form of a distribution header, is usually of a tapered configuration, tapering in the direction of flow and having, for example, configuration of a truncated cone or the equivalent thereof. At the downstream end of such a distribution header there is often a continuous by-pass flow. From this header the pulp stock is delivered to a number of so-called diffuser pipes which are distributed transversely of the machine with a constant spacing and which extend longitudinally in the direction of pulp stock flow from the header toward the lip slice, so that through such a distribution pipe system the pulp stock is conveyed away from the header toward the lip slice.

With a headbox according to group (a) referred to above, the air cushion damps or attenuates pressure fluctuations in a highly efficient manner because with such a construction the surface area of the pulp stock contacted by the air cushion is comparatively large while the depth of the pulp stock where it is contacted by the air cushion is relatively small in a direction perpendicular to the direction of flow of the pulp stock. Such headboxes also have the advantage that the air cushion usually extends up to a location which is very close to the discharge lip of the headbox, so that at the region between the location of action of the air cushion and the lip slice the opportunity for generation of new pressure fluctuations is very low.

In spite of the above advantages of the air cushion type of headbox, the latter has not been used in recent times and has to a great extent been replaced in the newest fast paper machines by hydraulic or fully hydraulic headboxes respectively referred to above under groups (b) and (c). This replacement of the air cushion headboxes with hydraulic headboxes is due to the fact that the hydraulic headboxes are easier to situate with respect to the new twin-wire formers. Also, they are relatively inexpensive to manufacture. The greater turbulence of the pulp jet discharging from the lip of such headboxes and its more favorable intensity distribution as well as the improved homogeneity of the pulp stock have also favored the use of such hydraulic headboxes.

However, as opposed to the above advantages, hydraulic headboxes have difficulties with respect to the pressure fluctuations referred to above. Quite often a headbox initially meant to be fully hydraulic is required to be subsequently fitted with one or more separate air tanks which are intended to provide a substitute for the air cushion of an air cushion headbox. With respect to the location of such separate air tanks, various design solutions are known, and in some of them the air tanks have been connected to the pulp stock pipe system in advance of the headbox while in others the air tanks are connected above the headbox itself, the connection being provided by way of connecting tubes or ducts communicating with an upper part of the headbox. With respect to the first type of construction, there is the drawback that pressure fluctuations generated upstream of the air tank may indeed be sufficiently damped, but in the region between the air tank and the lip slice of the headbox there are new pressure fluctuations originating from various sources such as, for example, errors in the configuration of the distribution header, and such new pressure fluctuations spread without attenuation up to the lip slice of the headbox resulting in base weight variations of the paper as referred to above. With the latter type of construction there is the drawback that with an air tank situated above the headbox, the height of the free liquid from the central axis of liquid flow is relatively great, or the communicating tubes or ducts from the headbox to the air tank must be dimensioned so as to be too narrow as compared with the main flow duct. In both cases the damping characteristics are substantially impaired, as compared with the pressure fluctuation equalizing capacity of a standard air cushion headbox.

SUMMARY OF THE INVENTION

It is accordingly a primary object of the present invention to provide a damping system capable of effectively damping pressure fluctuations occurring in pulp stock at a hydraulic headbox.

In addition it is an object of the present invention to achieve these results while utilizing a simple structure in such a way that the above-described drawbacks in connection with separate air tanks are avoided while at the same time a damping capacity of a standard air cushion headbox is closely approximated.

With the structure of the invention the header means of the headbox which delivers the pulp stock to the distribution pipe system and the flow-equalizing means which receives the pulp stock from the distribution pipe system and delivers it to the turbulence passage system form a pair of means at least one of which provides a chamber in which the pulp stock is situated while flowing in the headbox and which is defined in part by a wall means which is movable in response to pressure fluctuations in the pulp stock, an inner surface of this wall means directly contacting the pulp stock. An enclosure means is situated at this one of the pair of means which has the movable wall means, this enclosure means being provided for enclosing a gas such as air under pressure with an outer surface of the movable wall means being in contact with this gas under pressure so that the latter acts through the movable wall means on the pulp stock for damping pressure fluctuations therein. Thus, the movable wall means of the invention will respond to pressure fluctuations in the pulp stock contacting the inner surface of the movable wall means, and in response to such movement the gas under pressure in the enclosure means will act to damp the pressure fluctuations.

By way of the present invention it is possible to situate the action of the damping very close to the lip slice of the headbox so that there is no possibility for generation of significant new pressure fluctuations downstream of the damping location between the latter and the lip slice. When the structure of the invention is applied to the header means of the headbox, the area of the hollow interior of the enclosure means where the gas under pressure acts through the movable wall means on the pulp stock can be made relatively large while at the same time the depth of the pulp stock where it is acted upon by the movable wall means is relatively small, so that both of these circumstances will improve the damping capability of the system of the invention.

BRIEF DESCRIPTION OF DRAWINGS

The invention is illustrated by way of example in the accompanying drawings which form part of this application and in which:

FIGS. 7–10 respectively illustrate different possible embodiments of the system of the invention applied to the flow-equalizing chamber as the location of the damping system of the type illustrated in FIG. 6.

DESCRIPTION OF PREFERRED EMBODIMENTS

Figure 1:
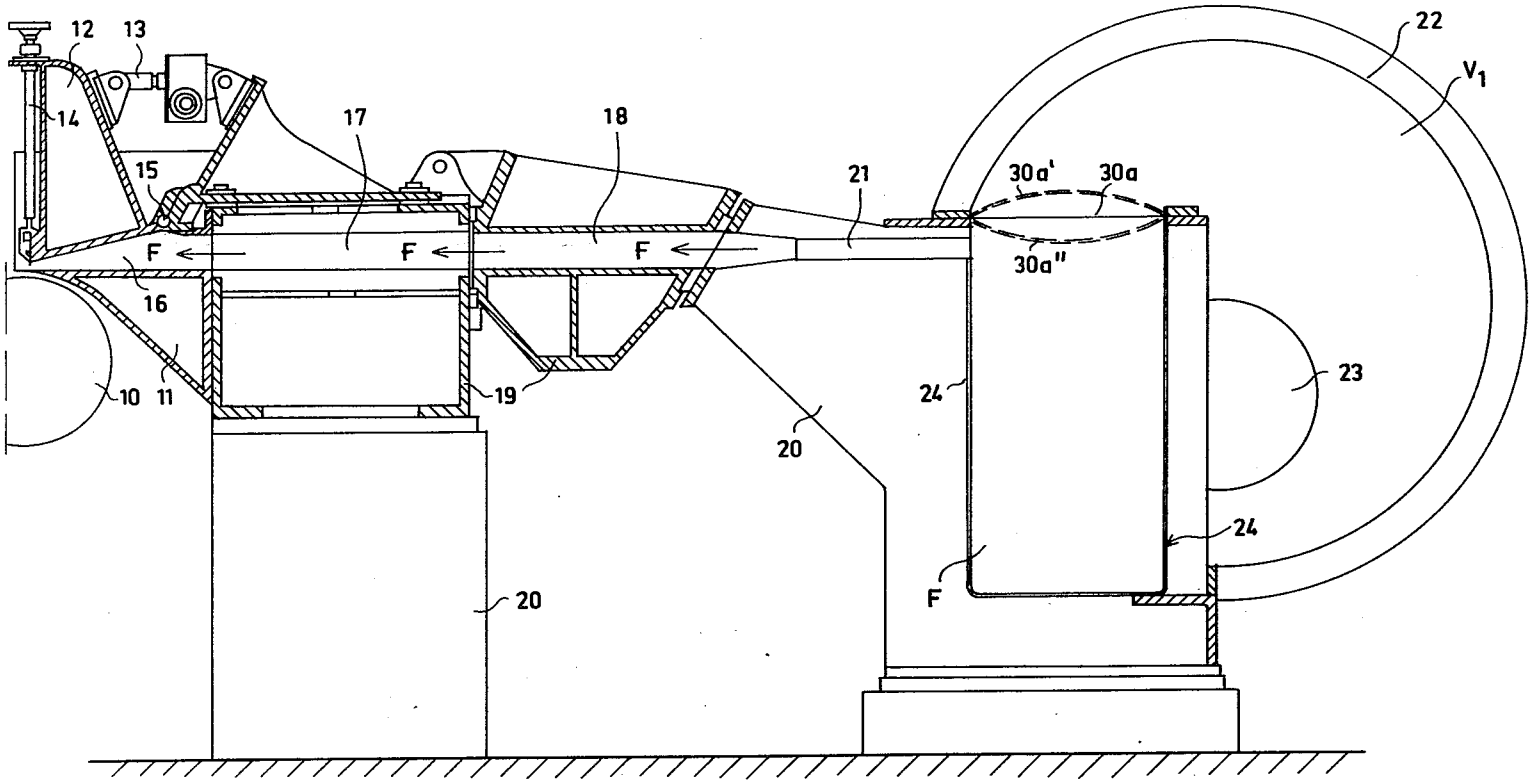
FIG. 1 is a schematic longitudinal sectional elevation of a headbox of the invention where the damping system of the invention is applied at the header means.

Referring to FIG. 1, there is schematically illustrated therein a modern hydraulic paper machine headbox which includes at its upstream end a header means 24 which in a known way receives pulp stock from an unillustrated pipe system, this header means 24 forming a tank or chamber in which the pulp stock is situated while having an elevation somewhat higher than the pipes 21 of a distribution pipe system or means which receives the pulp stock from the header means 24. The several pipes 21 are distributed transversely across the machine while extending in the direction of flow F, the distribution pipe means 21 delivering the pulp stock to a flow-equalizing means 18 in the form of a chamber which is relatively shallow while having a substantially rectangular configuration. Thus, the flow-equalizing means 18 also forms a chamber which receives the pulp stock from the pipes 21. From the flow-equalizing means 18, the pulp stock flows to a turbulence passage means or system 17 in the form of a series of relatively narrow channels extending longitudinally in the direction of flow and serving to convey the pulp stock from the flow-equalizing means 18 to the lip slice means 16 while acting to reduce turbulence in the flowing pulp stock. The lip slice means 16 receives the pulp stock from the turbulence passage means 17 and tapers toward the discharge slice shown at the left of FIG. 1 above the breast roll 10 which is fragmentarily illustrated and around which the forming wire is lapped to receive the pulp stock issuing from the headbox. The lip slice means 16 has an adjustable lip slice and includes a lower lip beam 11 as well as an upper lip beam 12 which is provided at its front portion with adjusting spindles 14 serving to adjust the cross section of the lip slice in a known way. Coarse adjustment of the lip slice is provided by way of the adjusting structure 13 utilized to turn the beam 12 about the pivot 15. The flow-equalizing means 18 and turbulence passage means 17 are provided with the schematically illustrated supporting structure 19 carried in turn by the frame structure 20 which also supports the other components of the headbox as schematically illustrated.

In FIG. 1 there is shown an enclosure means $V_1$ which contains a gas such as air under pressure, supplied from any suitable compressor through a suitable control valve which enables the pressure of the gas to be adjusted in the hollow interior of the enclosure means $V_1$. This enclosure means has an outer wall 22 reinforced by suitable arcuate ribs and extending around the upper and right side portions of the header means 24. The enclosure means $V_1$ also has a manhole 23 provided with a suitable cover and through which access may be had to the interior of the enclosure means as required for servicing purposes, for example. With the embodiment of FIG. 1 the pulp stock in the header means 24 has a pressure which is generally equal to the pressure of the gas in the enclosure means $V_1$.

The header means 24 of FIG. 1 thus forms a chamber in which the pulp stock is situated, and this chamber is defined in part by a wall means **30*a* in the form of an elastic sheet material. Thus this wall means 30*a* may take the form of a suitable rubber membrane permanently attached in a fluid-tight manner at its periphery to the upper portion of the header means 24 so that this elastic wall means 30*a* has an inner surface contacting the pulp stock in the header means 24 and an outer surface contacted by the gas under pressure in the enclosure means $V_1$. At the same time the wall means 30*a*** prevents the air in the enclosure means $V_1$ from contacting the flowing pulp stock.

The elastic wall **30*a* will automatically respond to pressure fluctuations in the pulp stock in the header means 24 so as to stretch or expand from the horizontal position shown in FIG. 1 either upwardly to the position 30*a*′ or downwardly to the position 30*a*″ depending upon whether there is an increase or a decrease in the pulp stock pressure, respectively. Of course such an increase or decrease in the pulp stock pressure will create a pressure differential with respect to the gas under pressure in the enclosure means $V_1$, so that this gas under pressure will act through the wall means 30*a*** on the pulp stock for damping the pressure fluctuations thereof.

Figure 2:
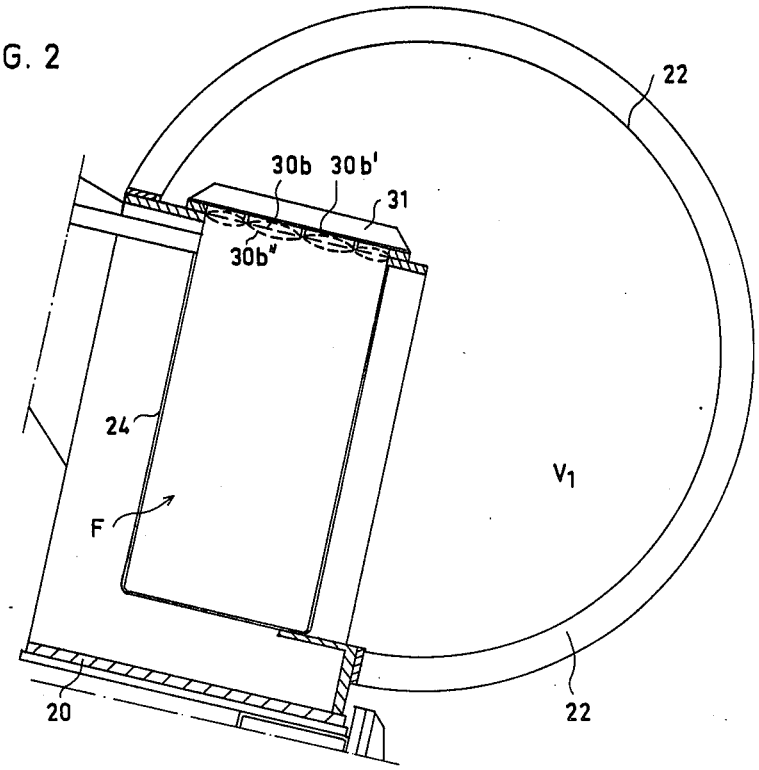
FIGS. 2–5 respectively illustrate different possible embodiments of the damping system of the invention associated with the header means.

The embodiment illustrated in FIG. 2 is substantially identical with that of FIG. 1. The difference is that in FIG. 2 the header means 24 as well as the distribution pipe system 21 communicating therewith are inclined as illustrated, and in addition in the embodiment of FIG. 2 a structure is provided to protect the elastic wall means against excessive deflection. Thus it will be seen that the elastic wall means **30*b* of FIG. 2, which is identical with the elastic wall means of FIG. 1, is in engagement at its outer surface with a plurality of spaced ribs or bars which extend transversely to the direction of pulp stock flow and which are fixedly carried by upper bars 31 which extend in the direction of flow and which are fixed at their opposite ends to the upper surface of the header 24 in the manner illustrated in FIG. 2. As a result the deflection of the elastic wall means 30*b* is limited to the spaces between the ribs and thus in this embodiment the elastic wall means can stretch between the positions 30*b*' and 30*b*''** as illustrated. Of course, instead of protective ribs it is possible to use perforated plates or the equivalent thereof as a protection against exposure of the rubber membrane to excessively high or excessively low pressures.

Figure 3:
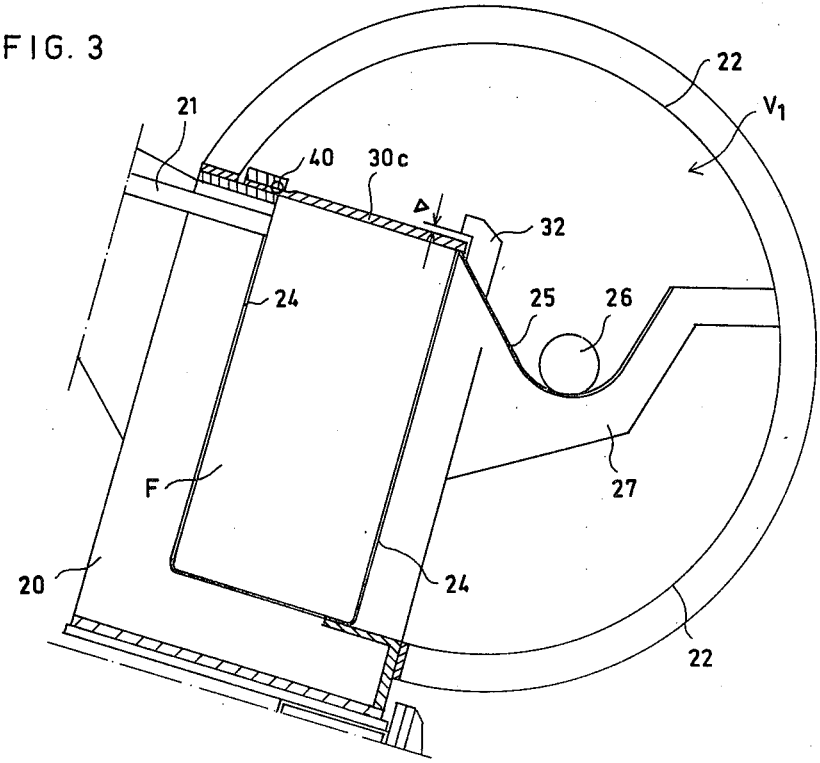

The embodiment of FIG. 3 is similar to that of FIG. 2 with respect to the inclination of the header means and distribution pipe means 21. However, in FIG. 3, instead of an elastic wall means, the wall means of the invention is still movable but takes the form of a substantially rigid plate **30*c* which in effect forms a cover for the header means 24. A hinge means 40 hingedly connects the plate 30*c* to the header means 24 for turning movement about an axis which extends transversely with respect to the direction of pulp stock flow, and it will be seen that this turning axis of the plate 30*c* is situated at the downstream end thereof. Thus, under the influence of pressure fluctuations of the pulp stock it is possible for the plate 30*c* to turn about the axis provided by the hinge means 40 while the right free edge of the plate 30*c*, as viewed in FIG. 3, moves up and down. The downward movement of this upstream edge of plate 30*c* is limited by the header 24 itself while the upward movement is limited by one or more stops 32 fixed in any suitable way in the position illustrated in FIG. 3 and having an upper left projection situated over the free upstream edge of the plate 30*c*** so that the latter can oscillate within the range Δ.

The stop elements 32 are actually fixed to a gutter or trough 25, the upper left edge of which is fixed to the upper edge of the right wall of the header 24 so as to be situated directly beneath the upstream free edge of the plate **30*c*. As a result when in response to pressure fluctuations the plate 30*c* tilts upwardly, some of the pulp stock will overflow out of the header 24 into the gutter 25, the lower end region of which communicates with a drainpipe 26. Thus, with this embodiment when the plte 30*c* tilts upwardly to an open position there is an overflow which equalizes also the pulp pressure fluctuations in the suspension flow F. Of course with the embodiment of FIG. 3 the hollow interior of the enclosure means $V_1$ still contains the gas such as air under pressure which acts through the wall means 30*c* on the pulp stock to damp pressure fluctuations therein. However, in this case the lower part of the air space in the enclosure means $V_1$ is limited to the right of the plate 30*c* by the trough 25 which is carried within the jacket 22 of the enclosure means $V_1$ by any suitable supporting structure 27** which is schematically illustrated.

Figure 4:
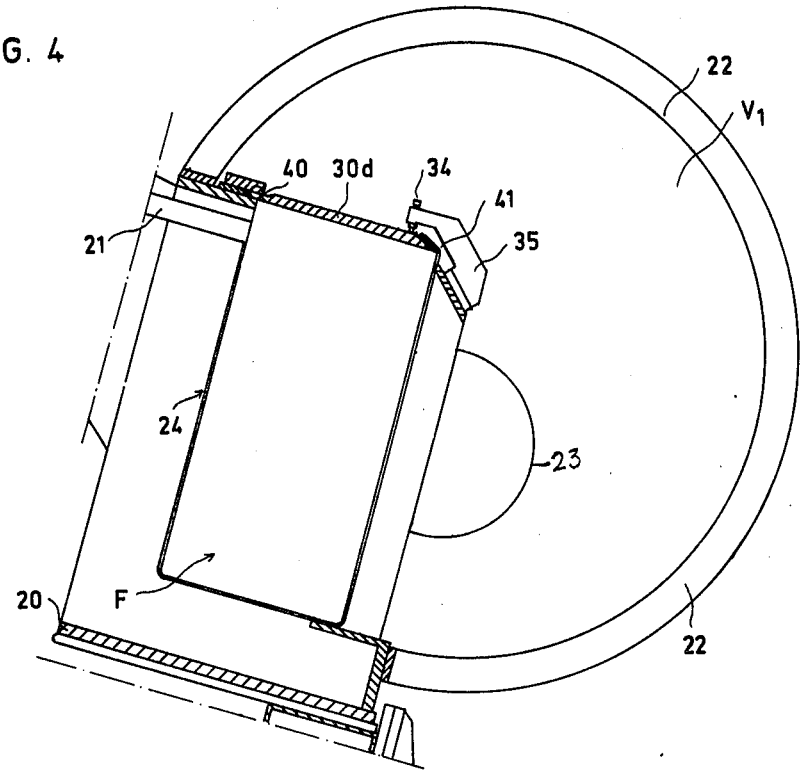
Figure 5:
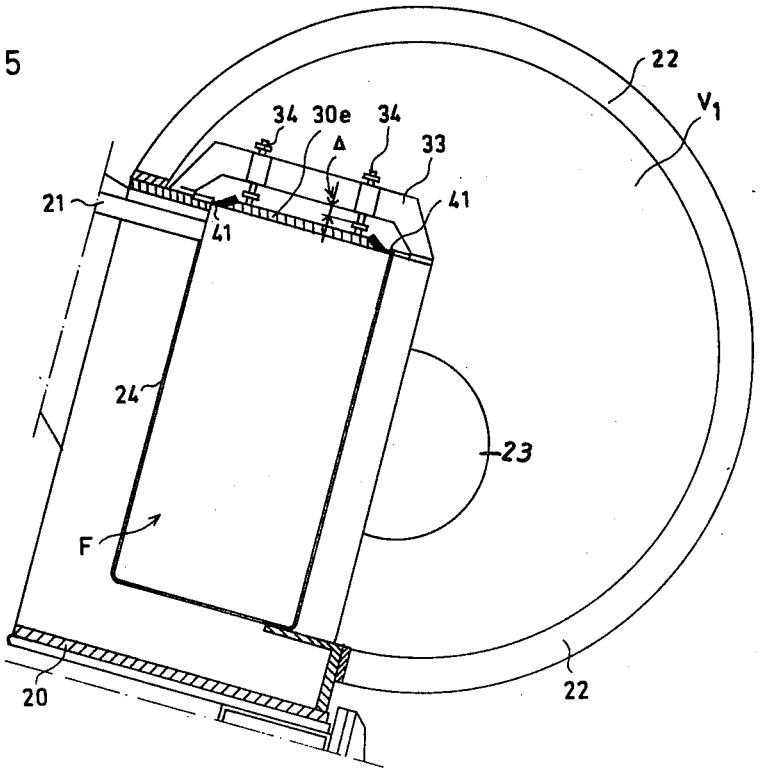

While an overflow for the pulp stock is provided in the embodiment of FIG. 3, such an overflow is not essential, as is apparent from the embodiments of FIGS. 4 and 5. Thus the embodiment of FIG. 4 is substantially identical with that of FIG. 3 except that there is no overflow. Instead with the embodiment of FIG. 4 the tiltable plate **30*d* which may be identical with the plate 30*c* and which is supported for tilting movement in the same way has its upstream free edge engaged by a sealing means 41 in the form of an elongated flexible resilient strip of rubber or the like fixed to the header 24 and overlapping the upstream free edge of the turnable wall means 30*d*. The opposed side edges of the wall means 30*d* may have a sliding fluid-tight engagement with inner surfaces of opposed end walls of the header 24 or additional sealing strips may be provided. With the embodiment of FIG. 4 the right wall of the header 24 carries a bracket structure 35 which extends over the movable wall means 30*d* where the bracket structure 35 is provided with suitable openings which receive pins 34 which are fixed at their bottom ends to the upper surface of the wall means 30*d*. The openings for the pins 34 are sufficiently great to provide for the desired extent of tilting movement of the wall means 30*d*. In addition the pins 34 will have thereon suitable stop nuts or the like capable of engaging the bracket structure 35 for limiting the extent of tilting movement of the wall means 30*d*. In this case the free edge of the wall means 30*d* terminates short of the right wall of the header 24, through a relatively short distance, so that the lowermost position of the wall 30*d* is determined by the stop structure 34 and not by the upper edge of the right wall of the header 24**.

The embodiment of FIG. 5 is substantially identical with that of FIG. 4 except that the plate **30*e* which forms the wall means of this embodiment is not hingedly mounted for turning movement. Instead a guide means guides the wall means 30*e* for movement without changing its attitude which is illustrated in FIG. 5. This guide means also includes a plurality of pins 34 which are fixed to and extend upwardly from the outer surface of the plate 30*e* which is contacted by the air under pressure in the enclosure means $V_1$. These pins 34 extend through suitable openings in the brackets 33 which are carried by the header 24 in the manner illustrated in FIG. 5. Thus by extending through these openings the pins 34 are guided together with the wall 30*e* for displacement in the manner apparent from FIG. 5. These pins 34 carry suitable stop nuts, collars, or the like, to limit the extent of displacement to the distance Δ, as indicated in FIG. 5. In this embodiment a plurality of sealing strips 41 are respectively fixedly mounted on the upper portion of the header 24 and overlap the entire peripheral edge region of the plate 30*e* so as to seal the chamber of the header 24**, in which the pulp stock is situated, from the hollow interior of the enclosure means $V_1$, where the gas under pressure is situated.

With all of the above embodiments of FIGS. 1–5, the damping means of the invention is associated with the chamber formed by the header means 24. In the embodiments of FIGS. 6–10, described below, the damping action is situated at the flow-equalizing means 18 which also forms a chamber through which the pulp stock flows.

Figure 6:
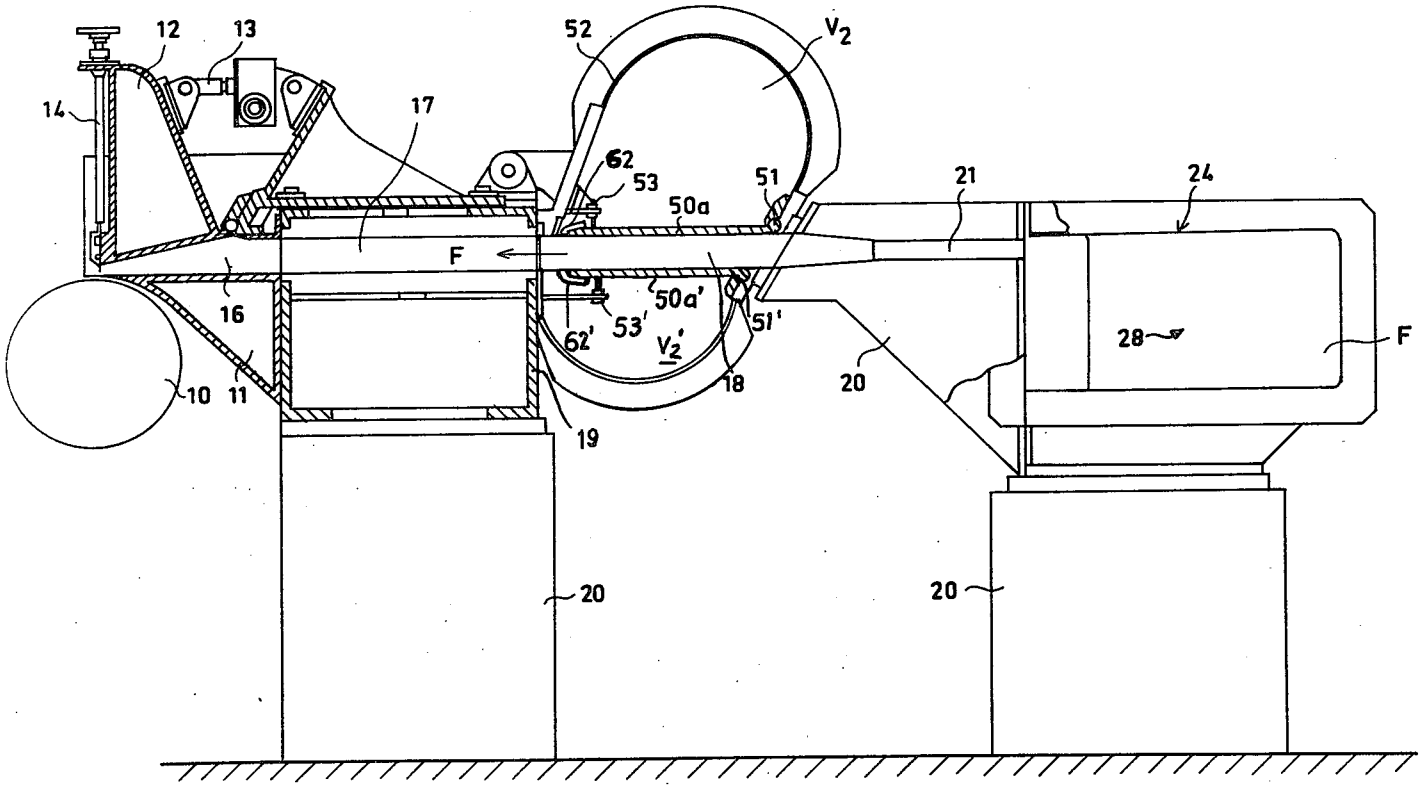
FIG. 6 is a schematic longitudinal sectional elevation illustrating a headbox where the damping system of the invention is applied to the flow-equalizing chamber.

Thus, referring to FIG. 6 it will be seen that the structure illustrated therein is substantially the same as that of FIG. 1 except that the header means 24 is shallower and in this case includes in its interior a vertical partition 28 which is inclined so that its left edge is situated closer to the distribution pipes 21 than its right edge which engages the right wall of the header 24. Thus the chamber formed by the header 24 in FIG. 6 will have a tapered configuration in horizontal plan.

With the embodiment of FIG. 6, the chamber formed by the flow-equalizing means 18 is defined in part by an upper plate 50*a* which forms the movable wall means of this embodiment, this plate 50*a* being supported at its upstream edge by a hinge means 51 for turning movement about an axis which extends transversely with respect to the direction of pulp stock flow F.

The enclosure means $V_2$ of FIG. 6 also contains a gas such as air under pressure and has a reinforced jacket 52. It will be seen that with this embodiment the inner or lower surface of the plate 50*a* directly contacts the flowing pulp stock while the outer or upper surface thereof defines part of the hollow interior of the enclosure means $V_2$ so as to be directly engaged by the gas under pressure.

The lower left region of the enclosure means $V_2$ carries stationary brackets formed with openings through which pins 53 extend with clearance sufficient to provide for the desired turning of the wall means 50*a* of the embodiment of FIG. 6. These pins 53 can also carry suitable stop nuts or the like for limiting the extent of tilted movement of the plate 50*a* in response to pressure fluctuations. The downstream peripheral edge region of the plate 50*a* is engaged by a sealing means 62 in the form of a strip of rubber or the like fixedly mounted at its left edge on the upper left portion of the flow-equalizing chamber 18 and extending from its left edge over the left free edge region of the plate 50*a* to fluid-tightly engage this left free edge region thereof while sealing the interior of the chamber of the flow-equalizing means 18 from the hollow interior of the enclosure means $V_2$. The opposed side edges of the plate 50*a* can also carry suitable sealing strips which are in slidable sealing engagement with the side walls of the chamber 18 and enclosure means $V_2$, these side walls forming a continuation of each other.

It will be seen that the above-described structure of FIG. 6 is shown in detail at the larger scale in FIG. 10 which is identical with the above-described structure of FIG. 6 except that in the case of FIG. 10 the headbox has the inclination illustrated in FIG. 10 and the lower wall of the flow-equalizing means 18 is fixed and formed by the stationary structure 19 as shown in FIG. 10.

In the embodiment of FIG. 6, the lower wall of the flow-equalizing chamber 18 is formed also by a tiltable wall means 50*a*′ supported by a hinge means 51′ and engaged at its downstream free edge by a sealing means 62′. The tilting movement of the lower wall 50*a*′ is limited by pins 53′ carrying suitable stop nuts and passing with sufficient clearance through openings formed in brackets carried by the supporting structure 19 as illustrated. Thus with the embodiment of FIG. 6 there are upper and lower movable wall means. In addition there is a lower enclosure means $V_2'$ which contains air under pressure acting against the outer or lower surface of the movable wall means 50*a*′. Of course the enclosures $V_2$ and $V_2'$ can form a single common enclosure having its hollow interior communicating with the outer surfaces of both of the wall means 50*a* and 50*a*′.

Figure 7:
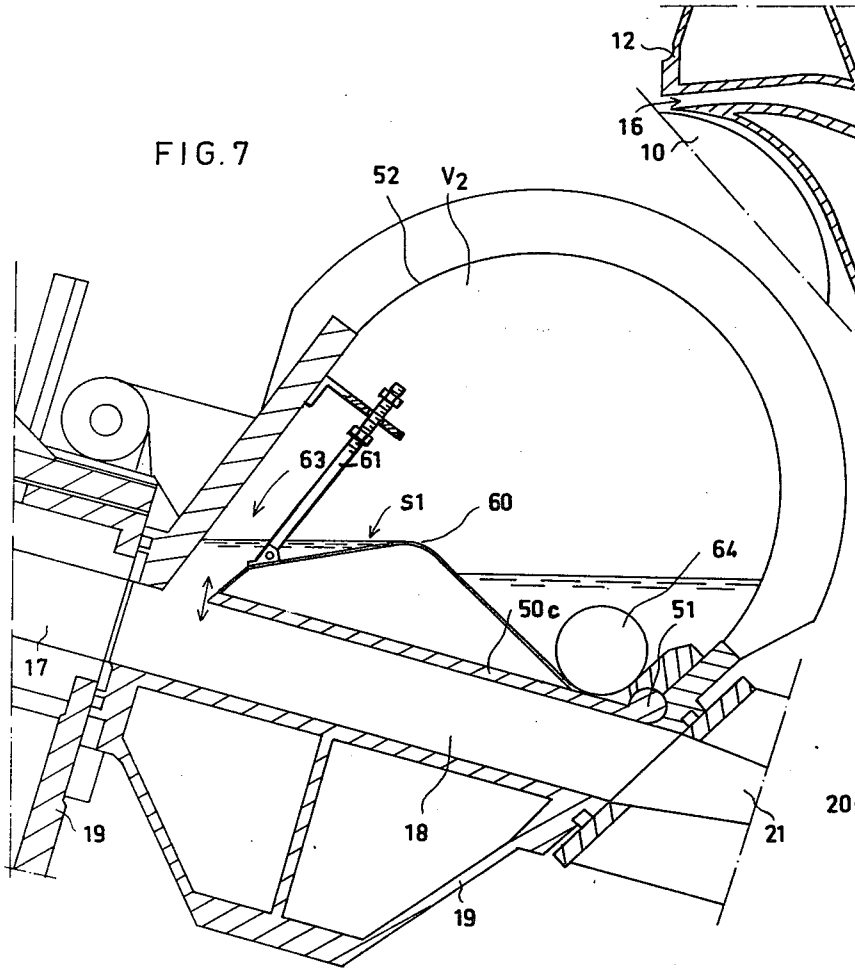

In the embodiment of the invention which is illustrated in FIG. 7, the wall means of the invention forms the top wall of the flow-equalizing means 18 and is in the form of a plate 50*c* supported for turning movement by the hinge means 51 about an axis which extends transversely with respect to the direction of flow. This turning axis of the plate 50*c* is situated at the upstream end thereof while the downstream free edge thereof is spaced from the adjacent wall of the enclosure means $V_2$ so that the pulp stock can freely flow through the aperture 63 formed in this way between the downstream edge of the tiltable plate 50*c* and the downstream end of the flow-equalizing chamber means 18. The upper surface of the plate 50*c* is formed by a weir means 60 carried by the plate 50*c* in the manner illustrated and providing an upper edge over which the pulp stock flows to reach the drain pipe 64. One or more rods 61 are hinged to the weir portion 60 of the tiltable plate means 50*c* and extend upwardly through openings of brackets fixed to the supporting structure, these openings having sufficient clearance to provide for longitudinal movement of the rods 61 during tilting of the plate means 50*c*, 60 of this embodiment. The rods 61 carry stop nuts which are threaded on these rods so that not only do they limit the extent of tilting movement of the plate 50*c* but also they can be utilized to adjust the elevation of the upper portion of the weir 60 so as to determine the elevation S1 of the pulp stock flowing through the aperture 63.

Figure 8:
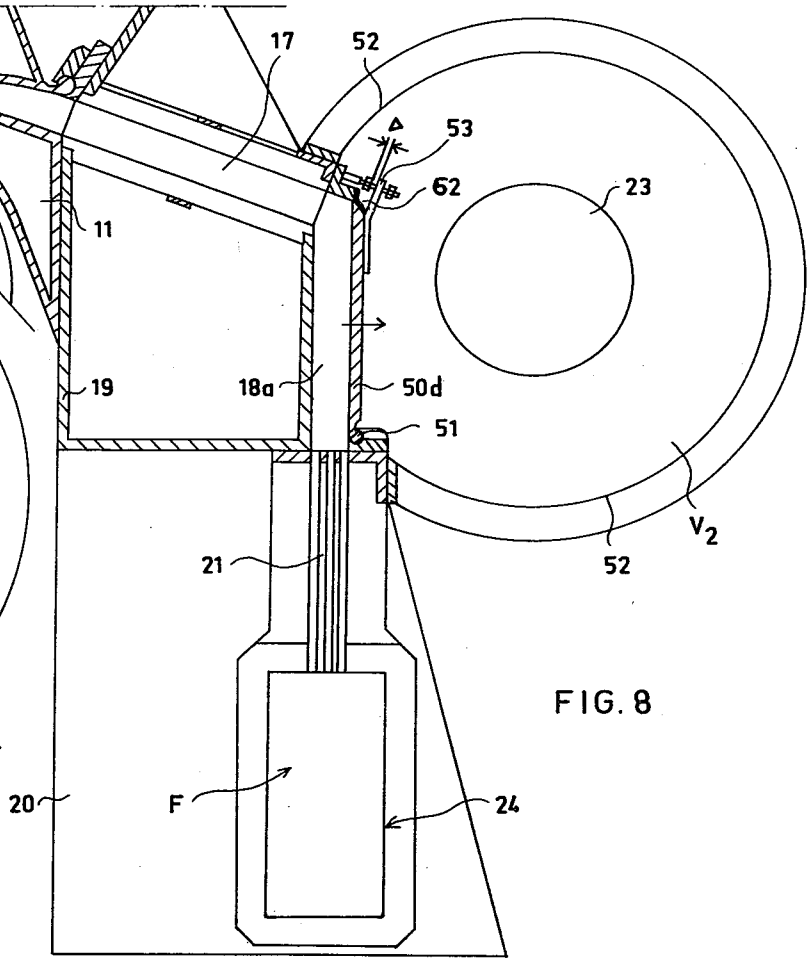

The embodiment of FIG. 8 differs from those described above in that the distribution pipe system 21 extends upwardly from the top end of the header means 24 and delivers the pulp stock to a vertically arranged flow-equalizing means 18*a* forming a chamber through which the pulp stock flows to reach the turbulence passage means 17. The right wall of the flow-equalizing means 18*a* is formed by a plate 50*d* which is also hingedly mounted at its upstream edge by a hinge means 51 for turning movement about an axis which extends transversely with respect to the direction of flow. Of course the enclosure means $V_2$ has its hollow interior communicating with the outer surface of the plate 50*d* while the inner surface thereof directly engages the pulp stock so as to respond to pressure fluctuations therein in a manner described above. In this case also the stationary supporting structure carries a sealing means 62 in the form of a rubber strip or the like which overlaps and engages the upstream free edge of the tiltable plate 50*d* so as to seal the interior of the enclosure means $V_2$ from the interior of the chamber of the flow-equalizing means 18*a*. In this case also the opposed side edges of the plate 50*d* can carry suitable sealing strips for contributing to the seal between the enclosure means $V_2$ and the flow-equalizing means 18*a*. With this embodiment the limiting pins are stationary, being fixedly carried by the same structure which carries the sealing strip 62. Instead there is a bracket 53 directly carried by the tiltable plate 50*d* and formed with openings through which the limiting pins extend with sufficient clearance to provide for the required tilting movement of the plate 50*d*. These limiting pins carry suitable stop nuts so as to limit the range of movement for example to the range Δ, as illustrated in FIG. 8.

The embodiment of FIG. 9 is in general similar to that of FIG. 5 except that in the embodiment of FIG. 9 the damping apparatus of the invention is associated with the flow-equalizing means 18 rather than with the header means 24. Thus, referring to FIG. 9 it will be seen that the movable wall means takes the form of a substantially rigid plate 50*b* which is guided for vertical movement within the range Δ indicated without changing its horizontal attitude. All of the free edges of the movable plate 50*b* are sealed by sealing strips 62 as schematically illustrated in FIG. 9. The plate 50*b* is fixed at its upper or outer surface, which communicates with the hollow interior of the enclosure means $V_2$, to lower ends of upwardly extending guide pins 53 which are guided through suitable openings or spaces defined between longitudinally extending bars through which the hollow interior of the enclosure means $V_2$ communicates freely with the upper or outer surface of the plate 50*b*. The stop nuts carried by the pins 53 are greater in area than the space between the bars through which the pins 53 are guided so that the stop pins will engage these bars to limit the extent of movement of the plate 50*b* in the manner illustrated. In addition it is possible to provide for suitable guide sleeves carried by the above bars and receiving the pins 53 as shown for the central pin 53 of FIG. 9.

With the above-described embodiments where the movable wall means of the invention takes the form of a hinged cover plate, for example, it is of advantage to provide the hinge means at the upstream edge of the movable plate so that the latter can respond sensitively to pressure fluctuations while at the same time having a fixed constant position for its upstream edge. By way of an overflow such as the overflow 63 of FIG. 7, any air contained in the pulp stock at the upper region thereof can be conducted away through the enclosure means. Moreover, by way of adjusting the rods 61 of FIG. 7 it is possible to provide an adjustment which is independent of the air cushion so that it is possible in this way to regulate the transverse profile of the flow. Of course, with several of the above-described embodiments there is no overflow, so that the stock flow F has no direct communication with the air cushion. By way of these structures where there is no overflow, it is possible to avoid potential overflow vortices if such should occur when an overflow is utilized.

Thus, with the above-described embodiments the damping system of the invention is utilized either in connection with the chamber formed by the header means or in connection with the chamber formed by the flow-equalizing means, although the invention also could be used with any other equivalent chamber of the headbox. However, it is to be understood that if necessary the damping systems of the invention may also be disposed both at the header means and at the flow-equalizing means. In this case it is possible to use at both of these locations either separate air tanks or a common joint air tank, or in the case of separate air tanks, the latter may be mutually interconnected. Of course these considerations also apply to the embodiment of FIG. 6 where the separate air tanks can be interconnected as pointed out above.

Of course, as shown in FIG. 6, the air tank may be situated below the equalizing chamber 18 with the latter having a lower wall means which is movable in response to the pressure fluctuations in accordance with the invention. However, in the particular example of FIG. 6 both the upper and lower walls are movable at the equalizing chamber, although the same type of arrangement can be provided if required at the header means. As is shown in FIG. 8, it is also possible to provide movable side walls at a chamber of the headbox where the pulp stock flows. Thus, for example, it is possible to provide the movable wall means of the invention at the side walls of a headbox chamber or at the side walls and/or bottom wall thereof, and of course where more than one air tank is provided these air tanks can be interconnected if desired or a common air tank may be utilized.

The invention of course is not to be narrowly confined in any way to the details set forth above and illustrated in the drawings inasmuch as these details may vary within the scope of the inventive concept defined by the claims which follow below.

What is claimed is:

1. A paper machine headbox comprising header means for receiving pulp stock, distribution pipe means communicating with said header means for receiving pulp stock therefrom and conveying the pulp stock beyond said header means, flow-equalizing means communicating with said distribution pipe means downstream of said header means for receiving the pulp stock from said distribution pipe means and equalizing the flow of the pulp stock, turbulence passage means communicating with said flow-equalizing means downstream of said distribution pipe means for receiving the pulp stock from said flow-equalizing means and conveying the pulp stock beyond said flow-equalizing means while reducing turbulence in the flowing pulp stock, and lip slice means communicating with said turbulence passage means downstream of said flow-equalizing means for receiving the pulp stock from said turbulence passage means and delivering the pulp stock to a lip slice which forms part of said lip slice means and through which the pulp stock discharges from the headbox, said header means and flow-equalizing means forming a pair of means for respectively providing chambers in which pulp stock is situated while flowing from said header means to said lip slice means, and at least one of said pair of means including a wall means comprising a solid plate which defines part of said chamber of said one means and which is operatively connected with part of said one means for movement with respect to the remainder of said one means for altering the volume of said chamber thereof, said plate having an inner surface for contacting the pulp stock to respond to pressure fluctuations therein so as to move in response to said pressure fluctuations to change the volume of the chamber of said one means, said plate having an outer surface which is directed away from the chamber of said one means, and enclosure means for enclosing a gas such as air under pressure, said enclosure means having a hollow interior for holding therein the gas under pressure and said outer surface of said plate defining part of the hollow interior of said enclosure means so that through said plate the gas under pressure in said enclosure means acts on the pulp stock in the chamber of said one means for damping pressure fluctuations in the pulp stock.

2. The combination of claim 1 and wherein a hinge means connects said plate to said one of said pair of means for turning movement with respect thereto about an axis which extends transversely with respect to the direction of flow of pulp stock from said header means toward said lip slice means.

3. The combination of claim 2 and wherein said plate has a peripheral edge region situated beyond said hinge means and sealing means situated at said peripheral edge region of said plate for sealing the hollow interior of said enclosure means and said chamber of said one means from each other.

4. The combination of claim 1 and wherein a guide means is operatively connected with said plate to guide the latter for movement in response to pressure fluctuations while maintaining the attitude of said plate substantially unchanged, said plate having a peripheral edge region, and sealing means situated at said peripheral edge region of said plate for sealing the hollow interior of said enclosure means and said chamber of said one means from each other.

5. The combination of claim 1 and wherein a hinge means connects said plate to said one of said pair of means for turning movement about an axis which extends transversely with respect to the direction of pulp stock flow from said header means toward said lip slice means, said plate having distant from said hinge means an elongated edge region past which pulp stock can overflow.

6. The combination of claim 1 and wherein said header means is said one of said pair of means and has upper and side portions around which said enclosure means extends.

7. The combination of claim 1 and wherein said flow-equalizing means is said one of said pair of means and said wall means extending along substantially the entire length of said flow-equalizing means in the direction of flow of pulp stock from said header means toward said lip slice means.

8. The combination of claim 7 and wherein said wall means forms a lower wall of said flow-equalizing means.

9. The combination of claim 7 and wherein said wall means forms an upright wall of said flow-equalizing means.

10. The combination of claim 7 and wherein said wall means forms an upper wall of said flow-equalizing means.

11. The combination of claim 1 and wherein a hinge means connects said wall means to said one of said pair of means for turning movement about an axis extending transversely with respect to the direction of flow of pulp stock from said header means toward said lip slice means, and the latter axis being situated at an upstream end of said wall means.

12. The combination of claim 1 and wherein a hinge means operatively connects said wall means to said one of said pair of means for turning movement about an axis extending transversely with respect to the direction of pulp stock flow from said header means toward said lip slice means, and said axis being situated at a downstream end of said wall means.

13. The combination of claim 1 and wherein a hinge means operatively connects said wall means to said one of said pair of means for turning movement with respect thereto about an axis extending transversely with respect to the direction of pulp stock flow from said header means toward said lip slice means, said wall means having distant from said axis an elongated edge past which pulp stock can overflow, and said wall means carrying at its outer surface a weir means forming an overflow edge over which the pulp stock flowing past said edge of said wall means can flow.

* * * * *